United States Patent [19]

Mikuni et al.

[11] Patent Number: 4,803,936

[45] Date of Patent: Feb. 14, 1989

[54] THREAD TENSION DEVICE FOR OVEREDGE SEWING MACHINES

[75] Inventors: Yoshio Mikuni; Osamu Koshinaka, both of Osaka, Japan

[73] Assignee: Maruzen Sewing Machine Co., Ltd., Osaka, Japan

[21] Appl. No.: 116,732

[22] Filed: Nov. 4, 1987

[51] Int. Cl.[4] ..... D05B 47/02

[52] U.S. Cl. ..... 112/254; 242/150 R

[58] Field of Search ..... 242/150 R; 112/162, 112/254, 97, 255

[56] References Cited

U.S. PATENT DOCUMENTS

| | | | |
|---|---|---|---|
| 3,356,050 | 12/1967 | Urscheler | 242/150 R |
| 3,941,068 | 3/1976 | Washburn | 112/162 |
| 3,967,657 | 7/1976 | Cugini | 242/150 R |

*Primary Examiner*—Andrew M. Falik

*Attorney, Agent, or Firm*—Lowe, Price, LeBlanc, Becker & Shur

[57] ABSTRACT

A plurality of tension disk assemblies in an overedge sewing machine are disposed on a shaft supported for rotation around its axis and are spaced apart from each other in an axially distributed relationship. Each tension disk assembly comprises first and second tension disks forming a pair for holding therebetween a thread to be tensioned. The first tension disk is movable in opposite directions axially of the shaft, and the second disk is substantially immovable in the direction of the axis of the shaft. The resilient force of a spring acts on each first tension disk, whereby the latter is pressed against the second tension disk associated therewith. When the shaft is turned, as by a manual operating lever, this rotary motion is converted into a linear motion through a cam device. This linear motion removes the resilient force of the spring from the first tension disk. Thus, a thread tension released state is established simultaneously in the plurality of tension disk assemblies.

16 Claims, 5 Drawing Sheets

THREAD TENSION DEVICE FOR OVEREDGE SEWING MACHINES

BACKGROUND OF THE INVENTION

1. Field of the Invention

This invention relates to a thread tension device for overedge sewing machines and particularly to improvements in the disposition of a plurality of tension disk assemblies each having a pair of tension disks.

2. Description of the Prior Art

As is known in the art, overedge sewing machines generally have a needle and a plurality of loopers which cooperate with said needle to form stitches by using a needle thread and a plurality of looper threads. Thread tension devices are provided each in the respective paths of travel of threads from respective bobbins to the needle and loopers.

Such a thread tension device usually comprises a tension disk assembly having a pair of tension disks for holding a thread therebetween, and a spring for pressing one tension disk against the other.

In a conventional overedge sewing machine, thread tension devices are separately prepared in association with the needle and loopers and are independently attached to the sewing machine body.

SUMMARY OF THE INVENTION

Accordingly, an object of the invention is to provide a thread tension device for overedge sewing machines wherein a plurality of tension disk assemblies are unitized so that they can be handled as a single part.

The thread tension device according to the invention has a shaft having a longitudinal dimension in its axial direction. The shaft is supported by support means such as a bracket housed in and fixed to the sewing machine frame so that the axis of the shaft is held in a fixed position. A plurality of tension disk assemblies are mounted on said shaft so that they are spaced apart from each other in axially distributed relationship. Each tension disk assembly includes first and second tension disks forming a pair to hold therebetween a thread to be tensioned. The first tension disk is movable in opposite directions axially of the shaft, while the other or second tension disk is inhibited from moving axially of the shaft in at least one direction away from the first tension disk. Tension adjusting spring means is provided for imparting a resilient force which acts to press the first tension disk against the second tension disk, said tension adjusting spring means having an active portion which applies a resilient force to the first tension disk.

Thus, according to the invention, since a plurality of tension disk assemblies are installed on a single shaft, it is possible to attain unitization using a simple arrangement; therefore, the operation of attaching the thread tension device to the sewing machine body can be simplified.

In a preferred embodiment of the invention, the shaft is installed so that it is rotatable around its axis. Further, the thread tension device according to the invention includes thread tension releasing means which, in response to the rotation of the shaft in one direction, displaces the tension adjusting spring means in a direction opposite to the direction of action of the active portion of the tension adjusting spring means, so as to inhibit the first tension disk from being pressed against the second tension disk, and manual operating means for rotatively operating said shaft in said one direction.

Typically, actuation of the thread tension releasing means is realized by a kind of cam device adapted to convert a rotative motion to a linear motion.

According to the preferred embodiment described above, the shaft can be given not only the function of holding a plurality of tension disk assemblies but also the function of motion transmitting means for establishing the thread tension released state in the tension disk assemblies. Therefore, the number of parts which constitutes the thread tension device can be reduced. Further, it is possible to establish the thread tension released state simultaneously in all the tension dsk assemblies mounted on the shaft when the shaft is rotated through the manual operating means.

In a more preferred embodiment of the invention, the device is provided, in addition to the aforesaid arrangement, with return rotation imparting means for imparting to the shaft a rotation counter to the rotation in said one direction or the rotation for releasing the thread tension. This return rotation imparting means can be realized simply by return spring means. In another embodiment this means comprises an arm rotatable integrally with the shaft, a drive shaft rotatively driven during sewing machine operation, and a release lever rotated by the drive shaft. The positional relationship between the arm and the release lever is selected so that the arm is positioned in the path of rotation of the release lever when the thread tension released state is established. In such arrangement, the thread tension released state is canceled when the rotating release lever abutting against the arm rotates the arm.

According to the specific embodiment described above, the thread tension released state is automatically canceled when the rotative operation on the shaft to attain the thread tension released state is stopped or when the sewing machine is started. Therefore, in starting the sewing machine, there is no need to make a visual inspection of the position of the manual operating member or a physical re-operation on the manual operating member for the purpose of imparting a desired tension to a thread, and such an improper operation, such as performing sewing with no tension applied to the threads by error, can be avoided.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
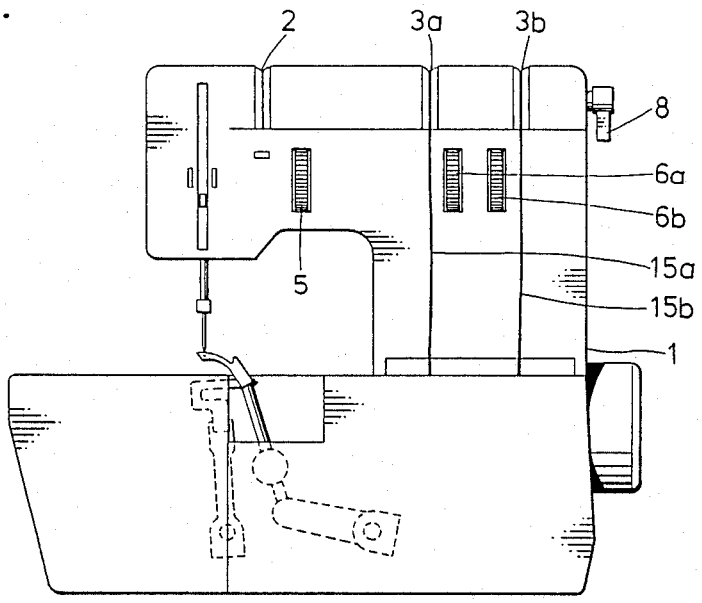
FIG. 1 is a front view showing the external appearance of an overedge sewing machine having an embodiment of the invention applied thereto.

An overedge sewing machine according to a preferred embodiment of this invention, as best seen in FIG. 1, has a thread tension device of the so-called concealed type. Thus, of the elements constituting the thread tension device, only three tension disk assemblies 2, 3*a*, 3*b* and three dials 5, 6*a*, 6*b* are partly seen projecting out of the frame 1, and also seen is an operating lever 8.

Figure 2:
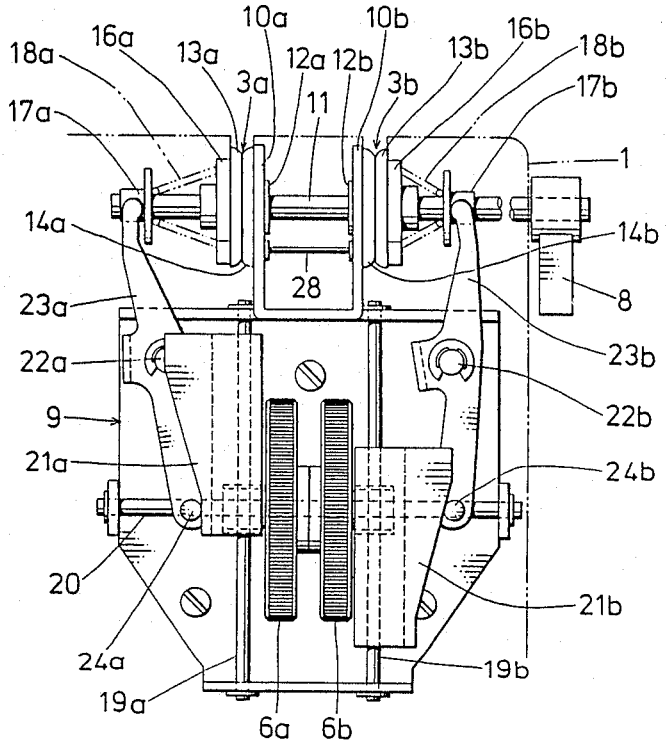
FIG. 2 is a front view of a thread tension device housed in the frame 1 of an overedge sewing machine shown in FIG. 1.

As shown in FIG. 2, a bracket 9 is fixed within the frame 1. The bracket 9 forms two attaching portions 10*a* and 10*b* extending upward and opposed to each other. A shaft 11 extends through these attaching portions 10*a* and 10*b* and its axis is held in a fixed position by the attaching portions 10*a* and 10*b*. The shaft 11 is rotatable around its axis. Further, the shaft 11 has stop rings 12*a* and 12*b* fixed thereon so that they respectively contact the opposed surfaces of the attaching portions 10*a* and 10*b*, whereby axial movement of the shaft 11 is inhibited.

The aforesaid tension disk assemblies 3*a* and 3*b* are mounted on the portions of the shaft 11 which are positioned outside the attaching portions 10*a* and 10*b*. To give a description with respect to the left-hand side tension disk assembly 3*a*, it has first and second tension disks 13*a* and 14*a* which forms a pair. A left-hand side looper thread 15*a* shown in FIG. 1 is held between said first and second tension disks 13*a* and 14*a*. A spring support disk 16*a* is mounted on the shaft 11 adjacent the first tension disk 13*a*. A spring holder 17*a* is mounted on shaft 11, and a coil spring 18*a* is disposed between said spring holder 17 and said spring support disk 16*a*.

In association with the elements disposed on said shaft 11, the first tension disk 13*a*, spring support disk 16*a* and spring holder 17*a* are movable in opposite directions axially of the shaft 11. The second tension disk 14*a* is inhibited from moving axially of the shaft 11 in at least one direction away from the first tension disk 13*a*. In this embodiment, movement of the seoond tension disk 14*a* away from the first tension disk 13*a* is inhibited by the second tension disk 14*a* abutting against the attaching portion 10*a*. In addition, the second tension disk 14*a* may be installed so that it does not move axially of the shaft in either direction.

The bracket 9 has attached thereto two vertical shafts 19*a* and 19*b* and a horizontal shaft 20 extending at right angles with said vertical shafts 19*a* and 19*b*.

To describe the arrangement with respect to the vertical shaft 19*a*, it has a plate cam 21*a* attached thereto so that it is slidable in the direction in which the vertical shaft 19*a* extends, while the horizontal shaft 20 has said dial 6*a* rotatably mounted thereon. The dial 6*a* has a pinion (not shown) integral therewith, while the plate cam 21*a* has a rack (not shown) meshing with said pinion. Therefore, rotative operation of the dial 6*a* causes the plate cam 21 to move vertically along the vertical shaft 19*a*. A spring force adjusting lever 23*a* is attached to the bracket 9 so that it is rotatable around the axis of a pivot pin 22*a*. A cam follower pin 24*a* is attached to one end of the lever 23*a* so that it contacts the camming surface of said cam plate 21*a*. The other end of the lever 23*a* engages said spring holder 17*a*. Thus, when the plate cam 21*a* is vertically moved by rotative operation of the dial 6*a*, as described above, the lever 23*a* is rotated, whereby the position of the spring holder 17*a* on the shaft 11 is changed. Therefore, the magnitude of the resilient force which the coil spring 18*a* applies to the first tension disk 13*a* through the spring support disk 16*a* is changed and so is the magnitude of the tension applied to the looper thread 15*a* (FIG. 1) held between the first and second tension disks 13*a* and 14*a*.

The above description has so far been given of the left-hand side elements shown in FIG. 2. The right-hand side elements including the tension disk assembly 3*b* are arranged so as to be symmetrical with respect to the left-hand side elements. By changing the letter "*a*" included in the reference characters used for the left-hand side elements to "*b*", the above description applies to the right-hand side elements.

Figure 3:
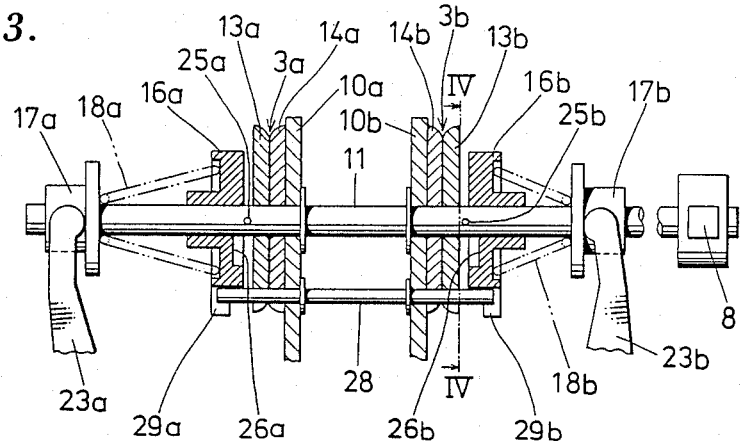
FIG. 3 is a sectional view of elements disposed on a shaft 11 in the overedge sewing machine shown in FIG. 1.
Figure 4:
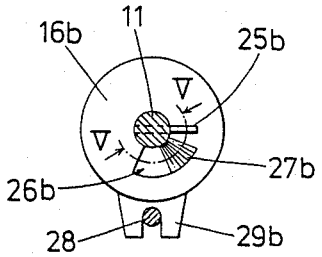
FIG. 4 is a sectional view taken along the line IV—IV in FIG. 3.
Figure 5:
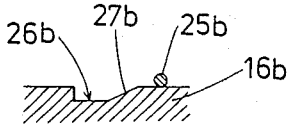
FIG. 5 is a sectional view taken along the line V—V in FIG. 4.
Figure 6:
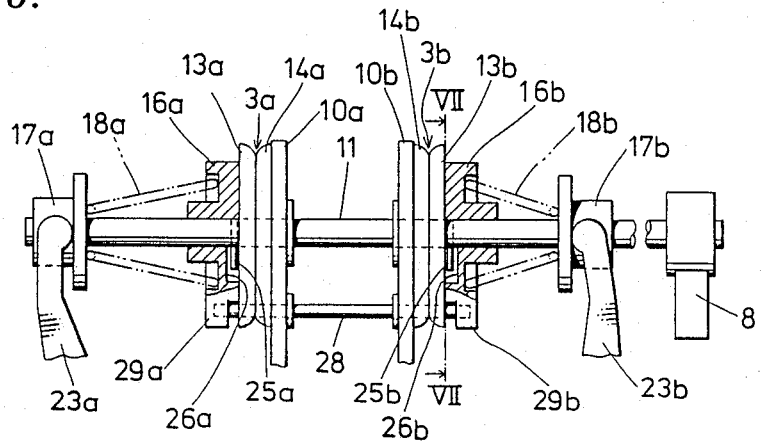
FIG. 6 is a view similar to FIG. 3, but showing the state in which the thread tension released state is canceled.
Figure 7:
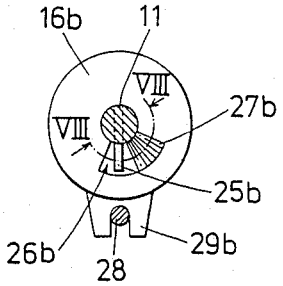
FIG. 7 is a sectional view taken along the line VII—VII in FIG. 6.
Figure 8:
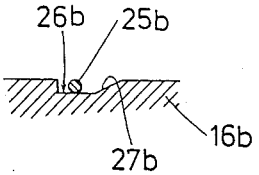
FIG. 8 is a sectional view taken along the line VIII—VIII in FIG. 7.

FIG. 3 shows the thread tension released state in which the first tension disks 14*a* and 14*b* are inhibited from being pressed against the second tension disks 14*a* and 14*b* associated therewith. FIG. 6 shows the thread tension released state being canceled. First, a description will be given in connection with the right-hand side spring support disk 16*b*. The shaft 11 is provided with a radially projecting pin 25*b*, while the spring support disk 16*b* is formed with a cam follower surface 26*b* capable of contacting a part of the peripheral surface of the pin 25*b*. The cam follower surface 26*b*, as best shown in FIGS. 4 and 5 or FIGS. 7 and 8, extends peripherally on one end surface of the spring support disk 16*b* and has an inclined surface 27*b*. In the state shown in FIG. 3, the pin 25*b* is positioned as it has climbed up the inclined surface 27*b* of the cam follower surface 26*b*, as shown in FIGS. 4 and 5, while in the state shown in FIG. 6, it is positioned as it has climbed down the inclined surface 27*b* of the cam follower surface 26*b*, as shown in FIGS. 7 and 8.

The above arrangement employed in connection with the right-hand side spring support disk 16*b* is also employed in connection with the left-hand side spring support disk 16*a*. Since these arrangements are substantially symmetrical with reference to each other, the above description also applies here by changing the letter "*b*" included in the reference characters used for the right-hand side elements to "*a*".

The spring support disks 16*a* and 16*b* are inhibited from rotating around the axis of the shaft 11 as the latter is rotated. For this purpose, a fixed shaft 28 extends through the opposed attaching portion 10*a* and 10*b* and is engaged at its opposite ends with engaging portions 29*a* and 29*b* extending from the spring support disks 16*a* and 16*b*, respectively. The manner of engagement between the fixed shaft 28 and the engaging portion 29*b* is shown in FIGS. 4 and 7.

As shown in FIGS. 3 and 6, the fixed shaft 28 is also engaged with the first tension disks 13*a* and 13*b* and the second tension disks 14*a* and 14*b*, thereby inhibiting rotation of these tension disks 13*a*, 13*b*, 14*a* and 14*b*; this, however, has nothing to do with the essence of the invention.

In connection with the embodiment described with reference to FIGS. 1 through 8, an operation for establishing the thread tension released state will now be described.

FIGS. 2 and 6 through 8 show the state in which thread tension released state is canceled, i.e., the state in which the first tension disks 13*a* and 13*b* are pressed against the second tension disks, respectively, by the springs 18*a* and 18*b*. In this state, if the operating lever 8 is rotated through about one fourth revolution counterclockwise as viewed in FIG. 7, or from the left-hand side in FIG. 6, the pins 25*a* and 25*b* move along the cam follower surfaces 26*a* and 26*b*, respectively. A description will be given of the pin 25*b* shown in FIGS. 7 and 8. In response to said counterclockwise rotation of the shaft 11, the pin 25*b* climbs up the inclined surface 27*b* to assume the position shown in FIGS. 4 and 5. As a result, the spring support disks 16*a* and 16*b* are displaced away from the first tension disks 13*a* and 13*b* against the resilient forces of the coil springs 18*a* and 18*b*, respectively, as shown in FIG. 3. As a result, the thread tension released state is established simultaneously in both of the tension disk assemblies 3*a* and 3*b*.

On the other hand, to cancel this thread tension released state, the operating lever 8 is rotated in the reverse direction to establish the state shown in FIGS. 2 and 6. In response thereto, and to give a description of one spring support disk 16*b*, the pin 25*b* in the position shown in FIGS. 4 and 5 climbs down the inclined surface 27*b* of the cam follower surface 26*b* to assume the position shown in FIGS. 7 and 8. Therefore, as shown in FIGS. 2 and 6, the spring support disks 16*a* and 16*b* are brought into contact with the first tension disks 13*a* and 13*b* by the coil springs 18*a* and 18*b*, respectively. In response thereto, the first tension disks 13*a* and 13*b*, under the action of the coil springs 18*a* and 18*b*, are pressed against the second tension disks 14*a* and 14*b*, respectively.

Figure 9:
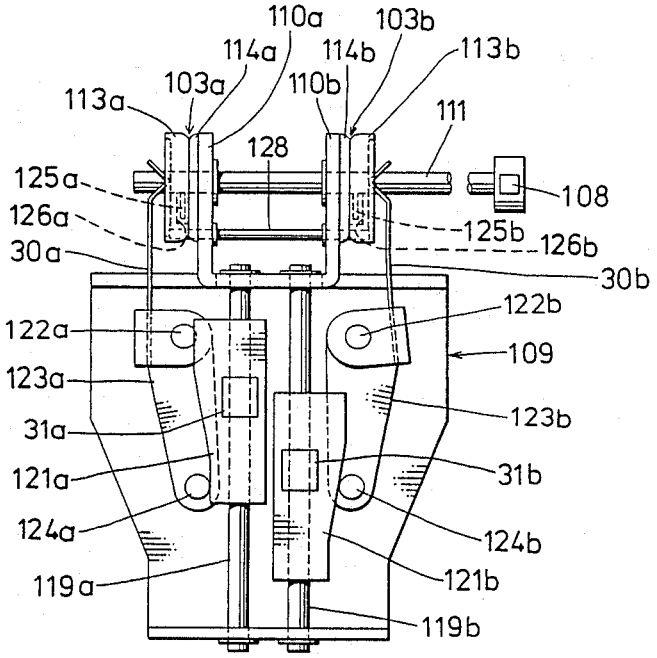
FIG. 9 is a front view of a thread tension device according to another embodiment of the invention.

FIG. 9 shows another embodiment of the invention. In addition, the embodiment shown in FIG. 9 includes a number of elements common to the arrangement shown in FIG. 2, and these common elements are denoted by reference numerals used in FIG. 2 plus "100" to avoid a repetitive description.

The embodiment shown in FIG. 9 is characterized in that the coil springs 18*a* and 18*b* are replaced by plate springs 30*a* and 30*b*. The plate springs 30*a* and 30*b* are fixed at one of their respective ends to spring force adjusting levers 123*a* and 123*b*, respectively. The other ends of the plate springs 30*a* and 30*b* abut against the first tension disks 113*a* and 113*b*. Therefore, the embodiment shown in FIG. 9 is characterized in that the spring support disks 16*a* and 16*b* and the spring holders 17*a* and 17*b* shown in FIG. 2 are not used, either.

Since the spring support disks 16*a* and 16*b* are not used, as described above, the first tension disks 113*a* and 113*b* are designed to have the function of the spring support disks 16*a* and 16*b*. That is, the first tension disks 113*a* and 113*b* are formed with cam follower surfaces 126*a* and 126*b*, as shown in dotted lines, while the shaft 111 is provided with pins 125*a* and 125*b*.

The embodiment shown in FIG. 9 is not provided with the dials 6*a* and 6*b* shown in FIG. 2. Instead, the plate cams 121*a* and 121*b* have knobs 31*a* and 31*b* directly attached thereto, respectively. These knobs 31*a* and 31*b* are exposed from the sewing machine frame 1, as shown in FIG. 1.

In the embodiment shown in FIG. 9, by rotatively operating the operating lever 108 to rotate the shaft 111 around its axis, the first tension disks 113*a* and 113*b* are spaced apart from the second tension disks 114*a* and 114*b* associated therewith, thereby establishing the thread tension released state. Further, by operating the knobs 31*a* and 31*b* to vertically slide the plate cams 121*a* and 121*b*, it is possible to adjust the resilient forces exerted by the plate springs 30*a* and 30*b* on the first tension disks 113*a* and 113*b*.

Figure 10:
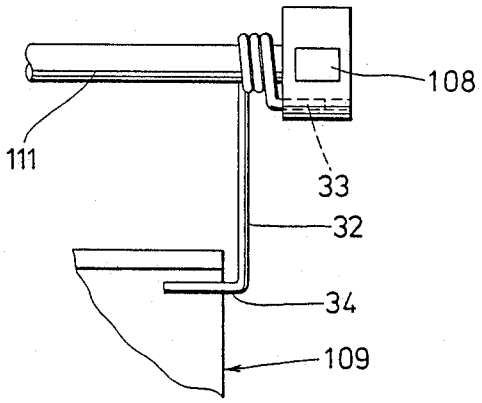
FIG. 10 is an enlarged partial sectional view showing a modification of the embodiment shown in FIG. 9.

FIG. 10 shows a modification of the embodiment shown in FIG. 9. More particularly, a return spring 32 in the form of, for example, a torsion spring, is provided in connection with the operating lever 108. The return spring 32 is mounted on the shaft 11 and is engaged at one leg 33 thereof with the operating lever 108 and at the other leg 34 with the bracket 109. When the operating lever 108 is rotated to establish the thread tension released state, the return spring 32 enables the operating lever 108 to automatically assume the position shown in FIG. 10 when the rotative action thereon is removed. Therefore, in starting the sewing machine after the thread tension released state has been established, it is no longer necessary to operate the operating lever 108 again.

In addition, the arrangement incorporating the return spring 32 can also be employed in the embodiment shown in FIG. 2.

FIGS. 11 through 16 show still another embodiment of the invention. This embodiment has a number of elements common to the embodiment described with reference to FIGS. 1 through 8. Thus, to avoid a repetitive description, reference characters including numerals used in the first embodiment plus "200" will be used.

Figure 11:
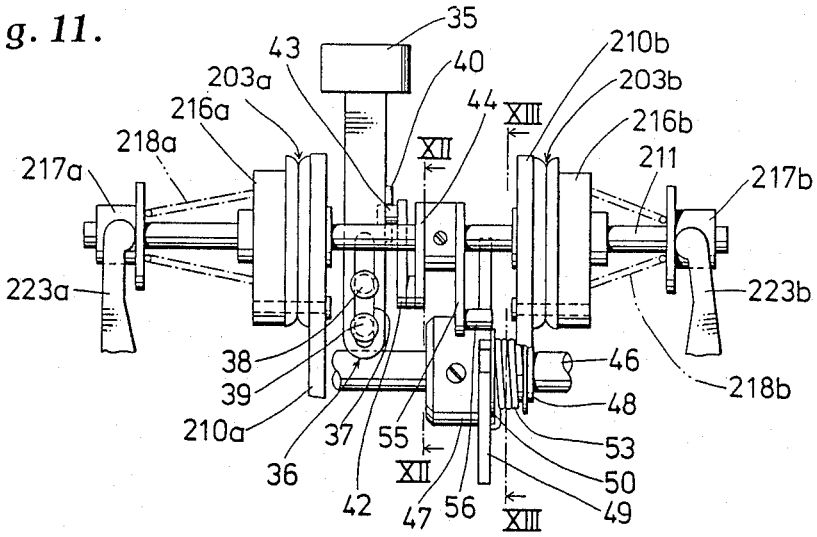
FIG. 11 is a front view of a thread tension device according to a further embodiment of the invention.
Figure 12:
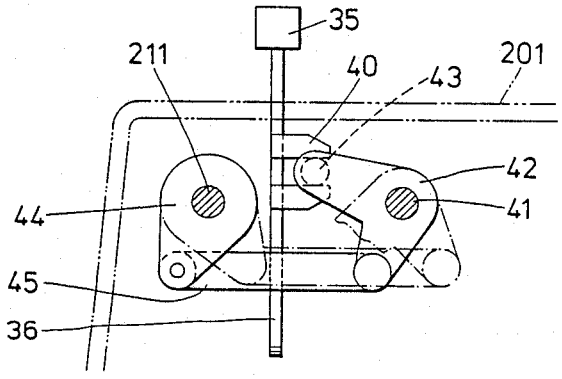
FIG. 12 is a sectional view taken along the line XII—XII in FIG. 11, showing an interlocking mechanism extending from a push button 35 to a shaft 211 shown in FIG. 11.

This third typical embodiment is characterized by the construction for rotatively operating the shaft 211. More particularly, as shown in FIGS. 11 and 12, a push button 35 is installed outside the frame 201 and is fixed on the upper end of a vertically extending actuator plate 36. The actuator plate 36 is formed with a vertically extending guide opening 37 in which two guide pins 38 and 39 arranged one above the other are received. The guide pins 38 and 39 are fixed on the frame 201 in a manner not shown. Thus, the actuator plate 36 is held for vertical movement in a predetermined range of length by the guide pins 38 and 39 received in the guide opening 37.

The actuator plate 36 is formed with vertically spaced engaging portions 40. On the other hand, an L-shaped lever 42 is turnably mounted on a shaft 41 fixedly installed in the frame 201. One end of the lever 42 is provided with a pin 43 engaged by the engaging portions 40.

An arm 44 is attached to the shaft 211 so that it is rotated with the latter, said arm 44 being operatively connected to the lever 42 by a link 45.

In such an arrangement, when the push button 35 is pushed downward from the position shown in FIG. 12, the L-shaped lever 42 is turned to the position shown in phantom lines. The arm 44 is thereby turned to the position shown in phantom lines through the link 45 and, in response thereto, the shaft 211 is turned through a predetermined angle. In response to such turning movement of the shaft 211, the thread tension released state is established or canceled, as in the preceding embodiments. In addition, in FIG. 12, it is to be understood that when the arm 44 is in the phantom line position, the thread tension released state is established, and that when it is in the solid line position the thread tension released state is canceled.

The embodiment being described is arranged so that when the sewing machine is started even in the thread tension released state, this state is automatically canceled. This arrangement will now be described with reference to FIGS. 11 and 13 through 16.

The sewing machine is provided with a motor for driving various actuating parts, and the main shaft is rotated by this motor. A drive shaft 46 shown in FIG. 11 may be such a main shaft or some other shaft than the main shaft to which rotation is transmitted from the main shaft. A collar 47 is fixed on the drive shaft 46 and has a release lever 49 attached to the boss portion 48 thereof by a stop ring 50 which prevents its axial movement, said release lever 49 having two diametrically projecting wings. The collar 47 is provided with two diametrically spaced stoppers 51 and 52. The release lever 49 is turnable relative to the collar 47, the range of turning movement of the collar 47 relative to the release lever 49 being limited by the release lever 49 abutting against said stoppers 51 and 52. A cushion spring 53 in the form of a torsion spring is mounted on the boss portion 48 of the collar 47. One end of the cushion spring 53 is fixed to the boss portion 48 and the other end to the release lever 49. The cushion spring 53 urges the release lever 49 to turn in the direction of arrow 54 until the release lever 49 abuts against the stoppers 51 and 52.

On the other hand, an arm 55 is attached to the shaft 211 for rotation with the latter. The front end of the arm 55 is provided with a pin 56. The position of the pin 56 is selected so that it is in the plane of rotation of the release lever 49, as seen from FIG. 11.

Figure 13:
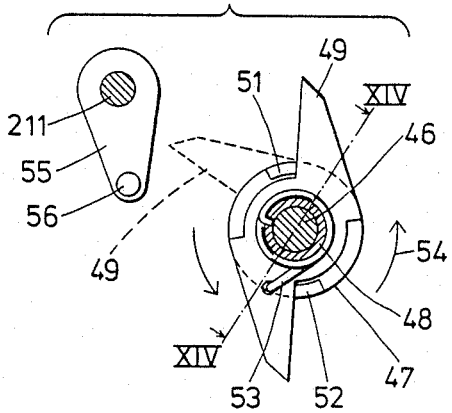
FIG. 13 is a sectional view taken along the line XIII—XIII in FIG. 11, showing the positional relationship between an arm 55 and a release lever 47 shown in FIG. 11.
Figure 14:
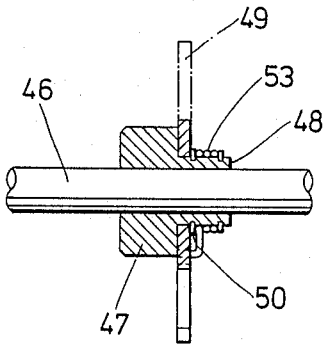
FIG. 14 is a sectional view taken along the line XIV—XIV in FIG. 13, showing how the release lever 49 is installed.

The position of the arm 55 show in FIG. 13 corresponds to the state in which the thread tension released state is canceled, namely, the operating state of the sewing machine. In such operating state, the drive shaft 46 is rotated in the direction of arrow 54 and with this rotation the release lever 49 is also rotated in the same direction; however, the pin 56 is not positioned in the path of rotation of the release lever 49. Therefore, the presence of the pin 56 and arm 55 has no influence on the rotation of the drive shaft 46.

Figure 15:
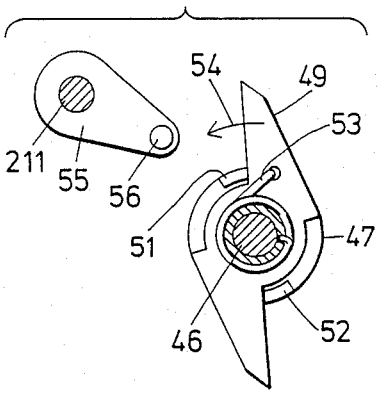
FIGS. 15 and 16 are views corresponding to FIG. 13, for explaining the action of the release lever 49 on the arm 55.
Figure 16:
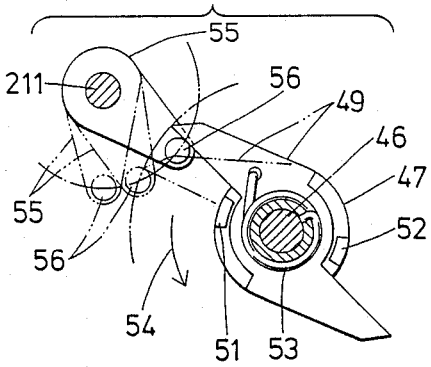

On the other hand, the state shown in FIG. 15 corresponds to the state in which the shaft 211 is rotated through about one fourth revolution to establish the thread tension released state, as described above. When the sewing machine is started in this condition, the drive shaft 46 is rotated in the direction of arrow 54 and in response thereto the release lever 49 is also rotated in the same direction. In the state shown in FIG. 15, the pin 56 is positioned in the path of rotation of the release lever 49, and when the release lever 49 is rotated in the direction of arrow 54, it abuts against the pin 56, as shown in FIG. 16. It would be expected that the instant the release lever 49 abuts against the pin 56, a high load would be imposed on the drive shaft 46. In this embodiment, however, such instantaneous imposition of a high load on the drive shaft is prevented. More particularly, immediately after the release lever 49 strikes the pin 56, the drive shaft 46 is rotated together with the collar 47 ahead of the release lever 49. In addition, the degree by which the drive shaft 46 moves ahead of the release lever 49 depends on the strength of the cushion spring 53. Eventually, the drive shaft 49 rotates with the drive shaft 46, progressively displacing the arm 55, as shown in phantom lines in FIG. 16, finally to the position shown in FIG. 13. In this manner, when the sewing machine is started, the thread tension released state is automatically canceled.

The fact that the release lever 49 is installed for rotation through a predetermined angle relative to the drive shaft 46 and has the cushion spring 53 further provides the following advantages. Suppose that the drive shaft 46 is stopped with the release lever 49 in the dotted position shown in FIG. 13. At this time, it is expected that if the arm 55 is turned to the position shown in FIG. 15 in order to establish the thread tension released state, the pin 56 strikes the release lever 49, which means that a high load is involved in an operation for establishing the thread tension released state. However, where the release lever 49 is turnably attached to the drive shaft 46 as in this embodiment, it is possible to allow the release lever 49 alone to escape from the path of travel of the pin 56 in response to the movement of the pin 56 described above without rotating the drive shaft 46. Therefore, there will not be much of a load involved in an operation for establishing the thread tension released state. Further, even if the release lever 49 is in the solid line position shown in FIG. 16 when the drive shaft 46 is started subsequent to an operation for establishing the thread tension released state, imposition of a high load on the motor in starting the sewing machine can be prevented since the drive shaft 46 can be rotated ahead of the release lever 49.

Figure 17:
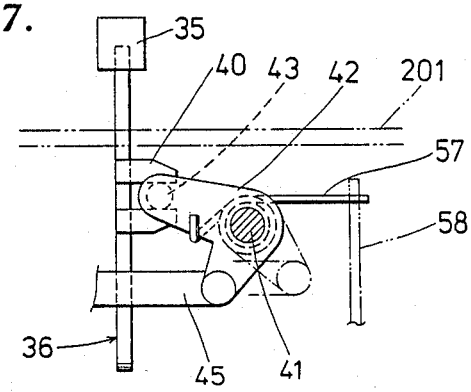
FIG. 17 is a view similar to FIG. 12, but showing another embodiment of the invention.

FIG. 17 shows still another embodiment of the invention. This figure corresponds to FIG. 12, and it can be regarded as a modification of the third typical embodiment described above.

Referring to FIG. 17, a return spring 57 in the form of a torsion spring is disposed in connection with the L-shaped lever 42. One end of the return spring 57 is engaged with the L-shaped lever 42 and the other end with an attaching portion 58 extending from the bracket (not shown). The return spring 57 serves to constantly urge the lever 42 to turn clockwise. Therefore, employment of the construction shown in FIG. 17 ensures that if the operation on the push button 35 is stopped, the thread tension released state is automatically canceled without having to use said release lever 49.

In the embodiments described so far, two tension disks 3*a* and 3*b* for imparting tension to two looper threads 15*a* and 15*b* shown for example in FIG. 1 have been unitized on a single shaft 11. However, three tension disk assemblies 2, 3*a* and 3*b*, with the tension disk assembly 2 shown in FIG. 1 included, may be installed on a single shaft.

Figure 18:
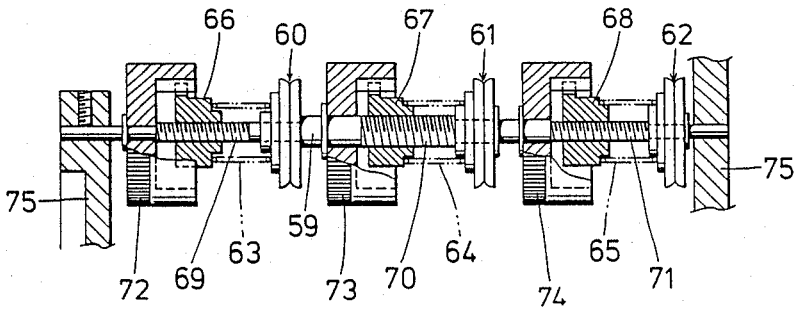
FIG. 18 is a front view of a thread tension device according to still another embodiment of the invention.

FIG. 18 shows such an example, in which three tension disk assemblies 60, 61 and 62 are mounted on a shaft 59 so that they are spaced apart from each other in an axially distributed relationship. Coil springs 63, 64 and 65 are associated with said tension disk assemblies 60, 61 and 62 and spring holders 66, 67 and 68 are screwed on the externally threaded portions 69, 70 and 71 of the shaft 59. Dials 72, 73 and 74 are rotatably mounted on the shaft 59 for rotating the spring holders 66, 67 and 68, respectively, relative to the shaft 59.

In this embodiment, if the dials 72, 73 and 74 are rotatively operated, the spring holders 66, 67 and 68 are displaced axially of the shaft 59 and hence the resilient forces of the coil springs 63, 64 and 65 acting on the tension disk assemblies 60, 61 and 62 are adjusted.

In FIG. 18, the shaft 59 has been installed so that it does not rotate around its axis relative to support means 75; however, the shaft 59 may be installed so that it can be rotated around its axis relative to the support means 75 by manual operating means to thereby establish the thread tension released state in each of the tension disk assemblies 60, 61 and 62.

Although the present invention has been described and illustrated in detail, it is clearly understood that the same is by way of illustration and example only and is not to be taken by way of limitation, the scope of the present invention being limited only by the terms of the appended claims.

What is claimed is:

1. A thread tension device for overedge sewing machines, comprising:

a shaft having a longitudinal dimension axially thereof;

support means for supporting said shaft with its axis held in a fixed position;

a plurality of tension disk assemblies mounted on said shaft so that they are spaced apart from each other in axially distributed relationship, each of said tension disk assemblies having corresponding first and second tension disks forming a pair to hold therebetween a thread to be tensioned;

each said first tension disk being axially movable in either direction with respect to said shaft;

each said second tension disk being inhibited from moving axially in at least one direction away from a corresponding one of said first tension disks; and tension adjusting spring means for each of said tension disk assemblies, having an active portion for exerting a resilient force on the corresponding first tension disk, said active portion serving to urge said corresponding first tension disk against the corresponding second tension disk as it is displaced in the direction of action of said resilient force, wherein said shaft is rotatable around its axis, and further including thread tension releasing means for displacing said active portion of said tension adjusting spring means in a direction opposite to the direction of action of said active portion in response to the rotation of said shaft in one direction, thereby inhibiting said first tension disk from being urged against said second tension disk, and manual operating means for rotatively operating said shaft in at least said one direction.

2. A thread tension device as set forth in claim 1, wherein:

said thread tension releasing means comprises rotatively actuating means adapted to be rotated with said shaft;

linearly operating means cooperating with said rotatively actuating means to form a cam device, said linearly actuating means being movable along the direction of the axis of said shaft and adapted to engage said active portion of said tension adjusting spring means and being urged by said resilient force into the state in which it is allowed to contact said rotatively actuating means;

rotation inhibiting means for inhibiting said linearly actuating means from being rotated around the axis of said shaft as it accompanies the rotation of said shaft; and said linearly actuating means being linearly moved in said axial direction together with said active portion in response to the rotation of said rotatively actuating means, the movement thereof in a direction so as to resist said resilient force in said linear movement causing said active portion to move against said resilient force, so that said resilient force from said active portion acting on said first tension disk is removed so as to establish a thread tension released state.

3. A thread tenion device as set forth in claim 2, wherein said rotatively actuating means includes a pin projecting radially from said shaft, and said linearly actuating means includes a disk-shaped member extending radially of said shaft and having a cam follower surface for contacting a portion of the periphery of said pin.

4. A thread tension device as set forth in claim 2, wherein:

said rotation inhibiting means includes a fixed member fixedly installed, and an engaging portion installed on said linearly actuating means which engages said fixed member.

5. A thread tension device as set forth in claim 2, wherein:

said linearly actuating means is formed by a portion of said first tension disk.

6. A thread tension device as set forth in claim 2, wherein:

said linearly actuating means is separate from and disposed adjacent said first tension disk.

7. A thread tension device as set forth in claim 1, wherein:

said manual actuating means includes an operating lever fixed on said shaft.

8. A thread tension device as set forth in claim 1, wherein:

said manual actuating means includes an operating member adapted to be operated for linear movement, and a link mechanism for transmitting said linear movement of said operating member to said shaft in such a way as to cause said shaft to rotate around its axis.

9. A thread tension device as set forth in claim 1, further comprising return rotation imparting means whereby a rotation in the direction opposite to said one direction of rotation of said shaft caused by said manual actuating means is imparted to said shaft.

10. A thread tension device as set forth in claim 9, wherein:

said return rotation imparting means includes return spring means for imparting a rotation in said opposite direction to said shaft.

11. A thread tension device as set forth in claim 9, wherein: said return rotation imparting means includes an arm adapted to rotate together with said shaft, a drive shaft rotatively driven during operation of the sewing machine, and a release lever rotated by said drive shaft, said arm being positioned in the path of rotation of said release lever when said thread tension released state exists, said thread tension released state being canceled by said release lever rotating said arm while abutting against said arm.

12. A thread tension device as set forth in claim 11, wherein:

said release lever is installed on said drive shaft so as to radially project from said drive shaft.

13. A thread tension device as set forth in claim 12, wherein:

said release lever is held so as to be turnable through a predetermined angle relative to said drive shaft, and further including a cushion spring urging said release lever to turn in one direction relative to said drive shaft, said release lever being turned relative to said drive shaft against the resilient force of said cushion spring.

14. A thread tension device as set forth in claim 1, wherein:

said tension adjusting spring means includes a coil spring positioned about said shaft.

15. A thread tension device as set forth in claim 1, further comprising:

means for adjusting the magnitude of said resilient force of said tension adjusting spring means.

16. A thread tension device for overedge sewing machines, comprising:

a shaft having a longitudinal dimension axially thereof;

support means for supporting said shaft with its axis held in a fixed position;

a plurality of tension disk assemblies mounted on said shaft so that they are spaced apart from each other in axially distributed relationship, each of said tension disk assemblies having first and second tension disks forming a pair to hold therebetween a thread to be tensioned;

said first tension disk being movable in opposite direction axially of said shaft;

said second tension disk being inhibited from moving axially in at least one direction away from said first tension disk; and tension adjusting spring means having an active portion to exert a resilient force on said first tension disk, said active portion serving to urge said first tension disk against said second tension disk as it is displaced in the direction of action of said resilient force, and wherein said tension adjusting spring means includes a plate spring extending from a fixed portion of the sewing machine.

* * * * *